United States Patent [19]

Kulesza et al.

[11] 4,325,551

[45] Apr. 20, 1982

[54] ELECTRONICALLY CONTROLLED GAME APPARATUS WITH PLAYING ARRAY POSITIONS ACTUATABLE BY A PLAYER CONTROLLED MOVABLE OBJECT

[75] Inventors: Ralph J. Kulesza, Chicago; Jeffrey D. Breslow, Highland Park; Howard J. Morrison, Deerfield; Gunars Licitis, Jr., Lombard; Rex M. Harper, Chicago, all of Ill.

[73] Assignee: Marvin Glass & Associates, Chicago, Ill.

[21] Appl. No.: 119,752

[22] Filed: Feb. 8, 1980

[51] Int. Cl.[3] ..... A63F 7/38

[52] U.S. Cl. ..... 273/110; 273/118 A; 273/1 GC

[58] Field of Search ..... 273/118 R, 118 A, 118 D, 273/121 A, 127 R, 127 B, 109, 108, 110, 119 A, 120 A, 856, DIG. 28

[56] References Cited

U.S. PATENT DOCUMENTS

| | | | |
|---|---|---|---|
| 3,675,927 | 7/1972 | Gottlieb et al. | 273/119 A |
| 3,938,807 | 2/1976 | Luthi et al. | 273/110 |
| 4,030,555 | 6/1977 | Boyce et al. | 273/110 |
| 4,034,985 | 7/1977 | Breslow et al. | 273/121 A |
| 4,093,232 | 6/1978 | Nutting | 273/121 A |
| 4,162,793 | 7/1979 | Cummings | 273/121 A |
| 4,207,087 | 6/1980 | Morrison et al. | 273/1 E |
| 4,216,963 | 8/1980 | Boucher | 273/110 |

*Primary Examiner*—Vance Y. Hum
*Assistant Examiner*—Leo P. Picard
*Attorney, Agent, or Firm*—Mason, Kolehmainen, Rathburn & Wyss

[57] ABSTRACT

An electronic game is provided having a playing field including an array of individually operable and selectively illuminated field array positions on which a game player attempts to maneuver a movable object over selected ones of the field array positions and actuate selected field array positions in accordance with the rules of the game. The player maneuvers the movable object by tilting or positioning of the playing field and game device with respect to a horizontal plane. The electronic game utilizes a microprocessor to control the progress of the game, to selectively illuminate playing field positions, to monitor the actuated field positions and to control the output of indications to the game player as to the progress of the game and the game player's score.

16 Claims, 13 Drawing Figures

MONITOR

GAME 1
FAST AND ACCURATE

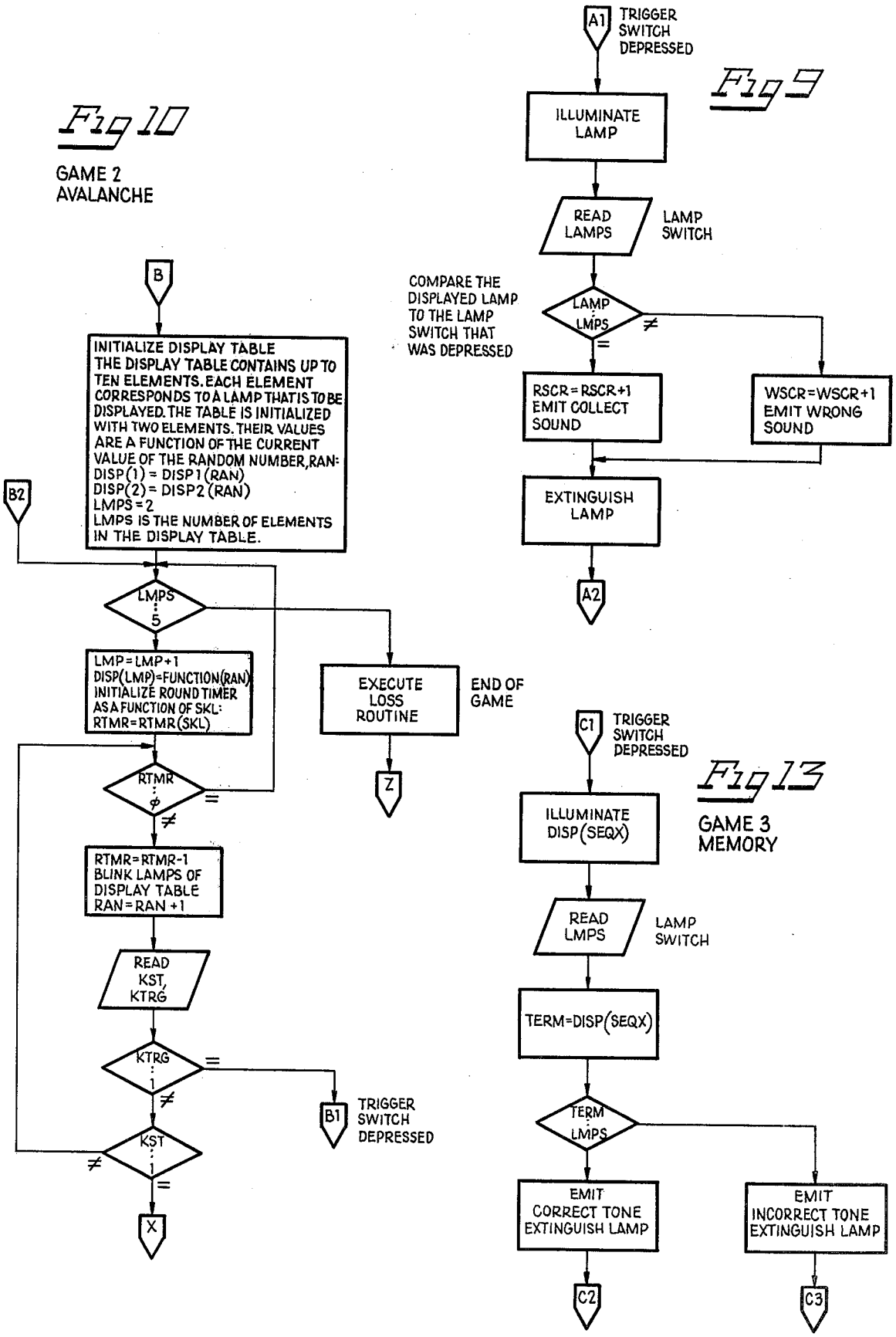
Fig 10
GAME 2
AVALANCHE
B
INITIALIZE DISPLAY TABLE
THE DISPLAY TABLE CONTAINS UP TO TEN ELEMENTS. EACH ELEMENT CORRESPONDS TO A LAMP THAT IS TO BE DISPLAYED. THE TABLE IS INITIALIZED WITH TWO ELEMENTS. THEIR VALUES ARE A FUNCTION OF THE CURRENT VALUE OF THE RANDOM NUMBER, RAN:
DISP(1) = DISP1(RAN)
DISP(2) = DISP2(RAN)
LMPS = 2
LMPS IS THE NUMBER OF ELEMENTS IN THE DISPLAY TABLE.
B2
LMPS
5
LMP = LMP+1
DISP(LMP)=FUNCTION(RAN)
INITIALIZE ROUND TIMER AS A FUNCTION OF SKL:
RTMR=RTMR(SKL)
EXECUTE LOSS ROUTINE
END OF GAME
Z
RTMR
ϕ
RTMR=RTMR-1
BLINK LAMPS OF DISPLAY TABLE
RAN=RAN+1
READ KST, KTRG
KTRG
1
B1
TRIGGER SWITCH DEPRESSED
KST
1
X
Fig 9
A1
TRIGGER SWITCH DEPRESSED
ILLUMINATE LAMP
READ LAMPS
LAMP SWITCH
COMPARE THE DISPLAYED LAMP TO THE LAMP SWITCH THAT WAS DEPRESSED
LAMP
LMPS
RSCR=RSCR+1
EMIT COLLECT SOUND
WSCR=WSCR+1
EMIT WRONG SOUND
EXTINGUISH LAMP
A2
Fig 13
GAME 3
MEMORY
C1
TRIGGER SWITCH DEPRESSED
ILLUMINATE DISP(SEQX)
READ LMPS
LAMP SWITCH
TERM=DISP(SEQX)
TERM
LMPS
EMIT CORRECT TONE EXTINGUISH LAMP
EMIT INCORRECT TONE EXTINGUISH LAMP
C2
C3

GAME 2
AVALANCHE

GAME 3
MEMORY

ELECTRONICALLY CONTROLLED GAME APPARATUS WITH PLAYING ARRAY POSITIONS ACTUATABLE BY A PLAYER CONTROLLED MOVABLE OBJECT

BACKGROUND OF THE INVENTION

A. Field of the Invention.

This invention relates generally to games and more particularly to an electronic playing field game that provides aural and visual indications of the progress of the game to the game participant.

B. Description of the Prior Art.

Various playing field games such as pinball games are known wherein a ball is propelled and maneuvered over various targets providing aural and visual indications in response to the movement of the ball over the various targets and the like to provide scoring information and subsequent play of the game.

For example U.S. Pat. No. 4,093,232 which issued to D. J. Nutting, et al. on June 6, 1978 discloses a pinball game having a playing field with ball directing lanes, targets and flipper elements for returning the ball. A programmed logic array is connected to the switches, response lamps, digit scoring lamps, and audible devices. A matrix circuit is connected to the switches and places information into a memory, the output of which is connected to activate lamps and audible devices which produces a continuous output if energized. A scanning decoder coupled to the matrix circuit is driven from the programmed logic array. In a particular implementation, a small microprocessor is housed in the pinball game and coupled through a 16 slot matrix board to a read only memory for activating the display means and the sensing of the various switch conditions in combination with the continuous test interlock system to maintain interlocking control of the system while play is in operation and storing of the condition with respect to subsequent play of the apparatus.

Other game apparatus is also known wherein projectiles are dropped or propelled at various targets for scoring purposes.

While the above-described game devices are generally suitable according to their intended use and provide amusement and interest, there is constant need for improved electronic board game devices.

SUMMARY OF THE INVENTION

Accordingly, it is an object of the present invention to provide an electronic game having a playing field including a plurality of actuatable playing field positions which are selectively illuminated by the game apparatus wherein a game player maneuvers a movable object over the playing field to actuate the playing field positions as they are selectively illuminated by the game apparatus in accordance with the play of the game.

It is another object of the present invention to provide a playing field game device that automatically illuminates a predetermined number of a plurality of playing field positions at random with a game player attempting to remember the momentarily illuminated playing field positions, attempting to maneuver a movable object over these playing field positions and actuating the appropriate playing field positions by means of a trigger control.

In accordance with a preferred embodiment of the present invention, there is provided an electronic game having a playing field including an array of individually operable and selectively illuminated field array positions on which a game player attempts to maneuver a movable object over selected ones of the field array positions and actuate selected field array positions in accordance with the rules of the game. The player maneuvers the movable object by tilting or positioning of the playing field and game device with respect to a horizontal plane. The electronic game utilizes a microprocessor to control the progress of the game, to selectively illuminate playing field positions, to monitor the actuated field positions and to control the output of indications to the game player as to the progress of the game and the game player's score.

DESCRIPTION OF THE DRAWINGS

These and other objects and advantages of the present invention will become apparent by reference to the following description taken in conjunction with the accompanying drawings wherein:

FIGS. 7 through 13 are logical flow diagrams illustrating the functions performed by the microprocessor controlling the operation of the game according to the present invention.

DETAILED DESCRIPTION OF THE PREFERRED EMBODIMENT

Figure 1:
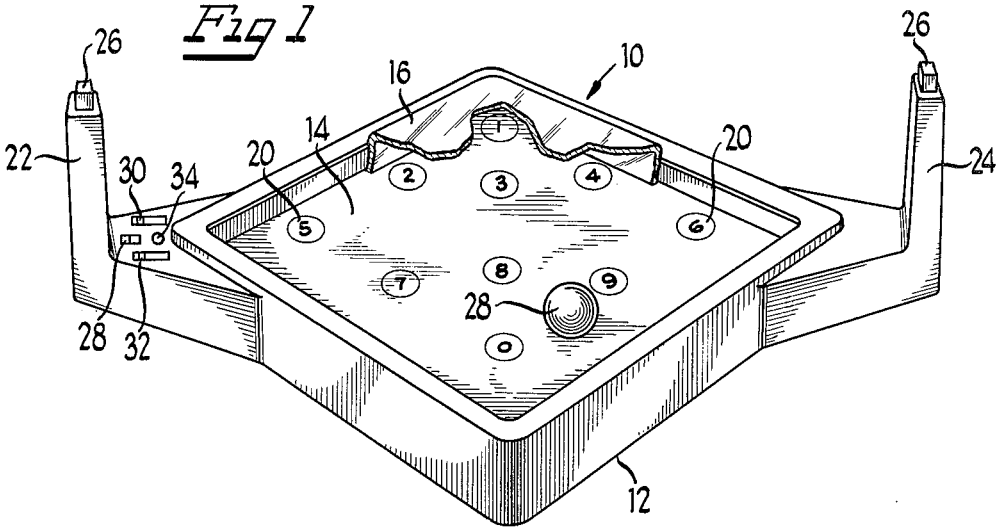
FIG. 1 is a perspective view of the preferred embodiment of a game device according to the invention.

Referring now to the drawings and with particular attention to FIG. 1, there is shown an embodiment of the game according to the present invention generally designated by the reference numeral 10. The game device 10 includes a housing 12 that supports a playing field 14 and a transparent playing field cover 16. A movable object 18 such as a ball or the like is movable over the playing area 14 in accordance with the orientation of the game device 10 and the playing field 14.

The playing field 14 includes a plurality of playing field array positions denoted as 20 in FIG. 1. In the preferred embodiment of FIG. 1, 10 playing field array positions 20 including indicia 0 through 9 are provided. The cover 16 is movable between a raised position to allow free movement of the movable object 18 and a lowered, clamping position causing the movable object 18 to actuate the playing field position 20 over which the object 18 is disposed. Thus, each of the playing field array positions 20 is selectively actuable in response to the positioning of the movable object 18 over one of the respective playing field array positions and to actuation of the cover 16 to the lowered position. Further, each of the playing field array positions 20 is selectively illuminated by the electronic control arrangement of the game device 10 either momentarily, continuously, or in a flashing mode in accordance with the play of the game as described in detail hereinafter.

The housing 12 includes two upstanding handle portions 22, 24 which are grasped by the game player to maneuver and orientate the game device 10 in order to maneuver the movable object 18 over selected predetermined playing array positions 20 as required by the play of the game. Each of the upstanding handle portions 22, 24 is provided with an actuator 26 that controls the position of the cover 16. Thus, the transparent cover 16 is movable between the raised and lowered positions in response to operation of the actuator 26.

The game device 10 includes various control selectors and switch arrangements for operation of the game 10. An on-off switch 28 controls the operational status of the game device 10 and the control circuitry thereof. A skill selector switch 30 and a game selector switch 32 are also provided to allow variations in the scheme of play in accordance with the connections to the control circuitry of the game device 10. A start switch 34 is provided to control the start of a particular play of the game as set on the various controls.

Referring now additionally to FIGS. 2 through 5, the bottom portion of the housing 12 includes a generally curved portion 36 such as a portion of a spherical shell to allow pivoting of the game device 10 and orientation of the playing surface 14 about a contact point of the curved portion 36 on a table top or other horizontal surface on which the game device 10 is disposed.

Figure 3:
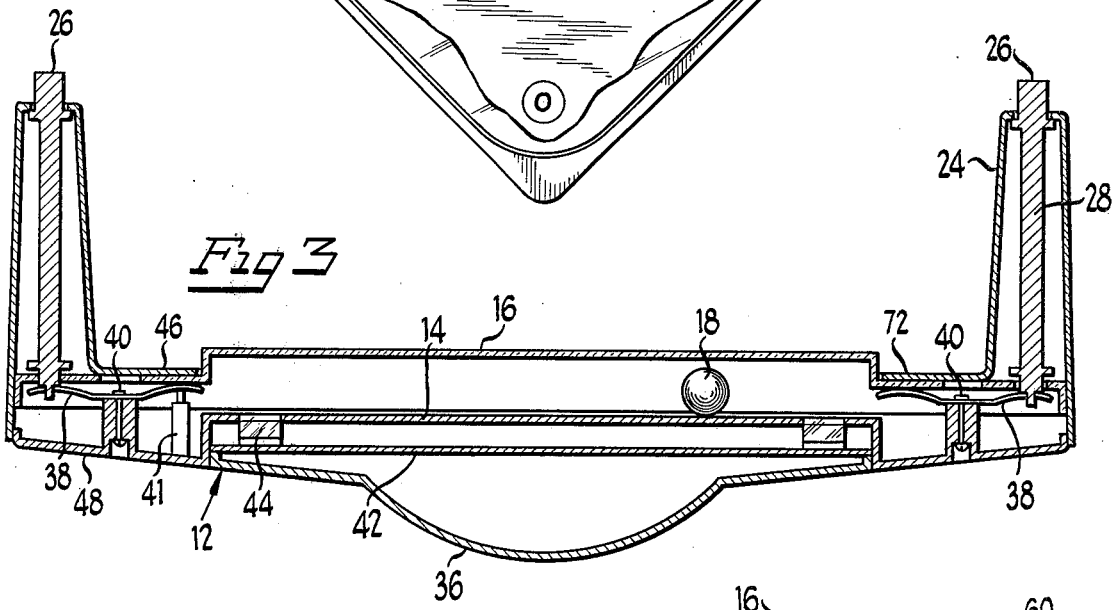
FIG. 3 is a sectional view of the game device of FIGS. 1 and 2 and taken along the line 3—3 of FIG. 2.

Thus, with the game participant grasping the handles 22, 24 and depressing the actuator 26, the movable object 18 is capable of being controlled or maneuvered about the playing surface 14 by pivoting of the game device 10. As best seen in FIG. 3, each of the actuators 26 includes an elongated portion 28 that engages a spring lever element 38. The spring lever element 38 is centrally pivoted at 40 and disposed to move the transparent cover 16 to the raised position in response to downward movement of the actuator 26. When the actuator 26 is released, the transparent cover 16 moves to the lowered position to actuate a playing field array position over which the movable object is disposed and to prohibit movement of the movable object 18. A trigger switch 41 is disposed on the housing 12 to sense the position of the cover 16. A mounting board 42 is positioned below the playing surface 14 with appropriate spacing between the component mounting board 42 and the playing surface 14 provided by spacer elements 44.

Figure 4:
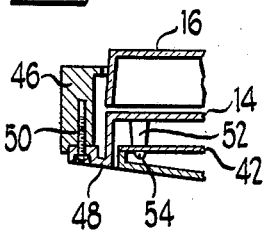
FIG. 4 is a sectional view illustrating portions of the housing of the game device of FIGS. 1 and 2 and taken along the line 4—4 of FIG. 2.

In the embodiment of FIGS. 1 through 5, the housing 12 may be suitably fabricated including an upper housing portion 46 and a lower housing portion 48 secured by suitable fasteners such as a screw 50 as best seen in FIG. 4. A semi-spherical bottom housing portion 36 may be integrally fabricated with the lower housing portion 48 or may be fabricated as a separate part and suitably attached to the lower housing portion 48. Also as best seen in FIG. 4, the component mounting board 42 is spaced from the bottom of the playing area 14 forming a portion of the lower housing portion 48 by a post 52 and a suitable fastener such as a screw 54 being provided to attach the component mounting board 42 to the lower housing portion 48.

Figure 5:
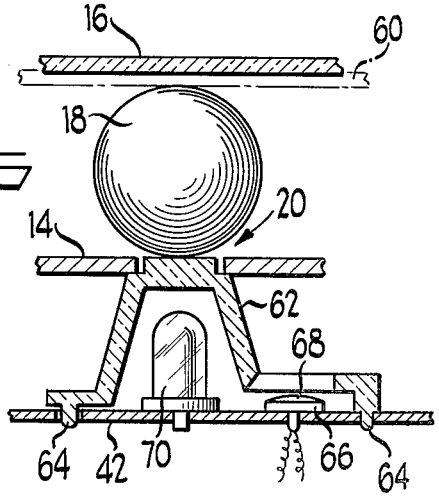
FIG. 5 is an enlarged sectional view of the game device taken along the line 5—5 of FIG. 2.
Figure 7:
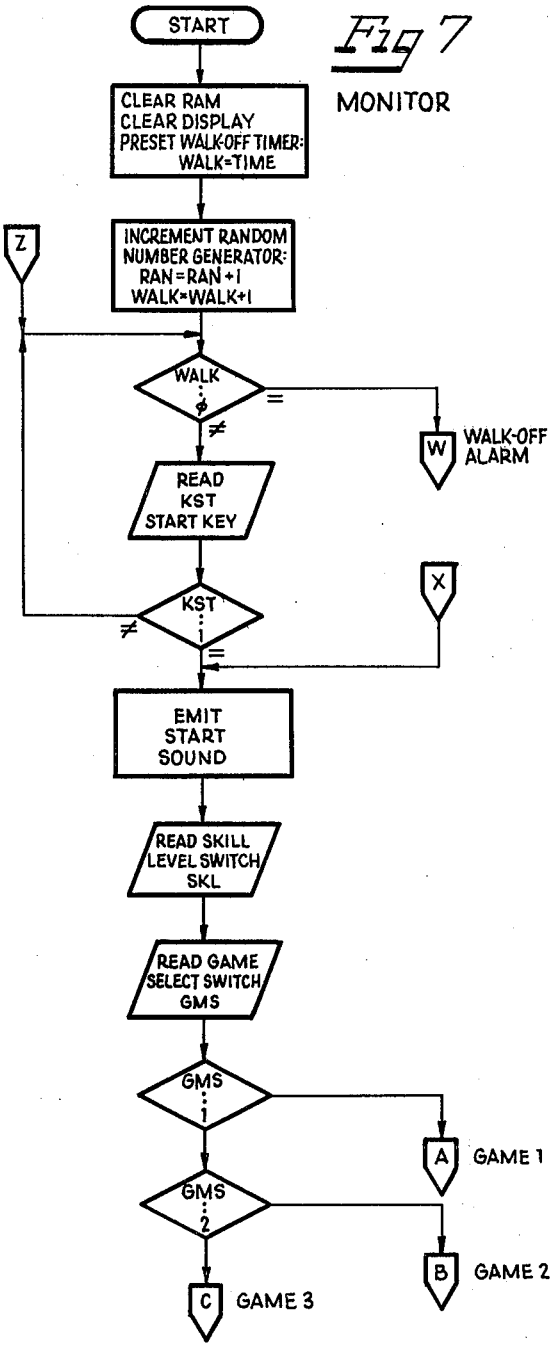
Figure 8:
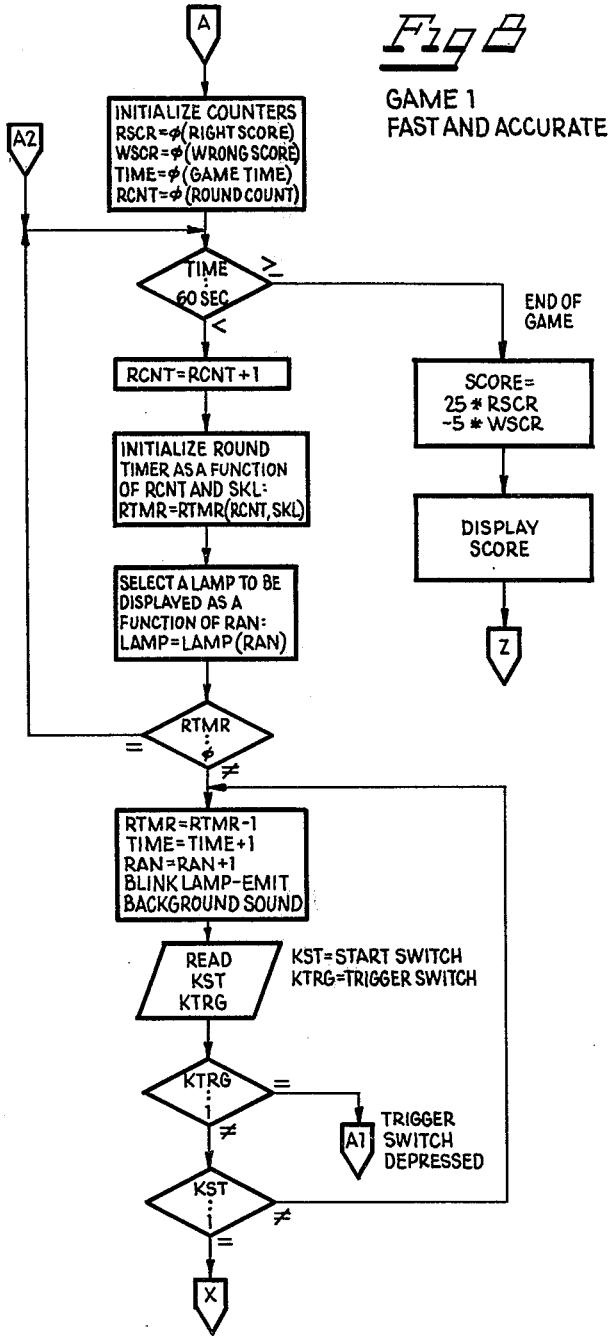
Figure 11:
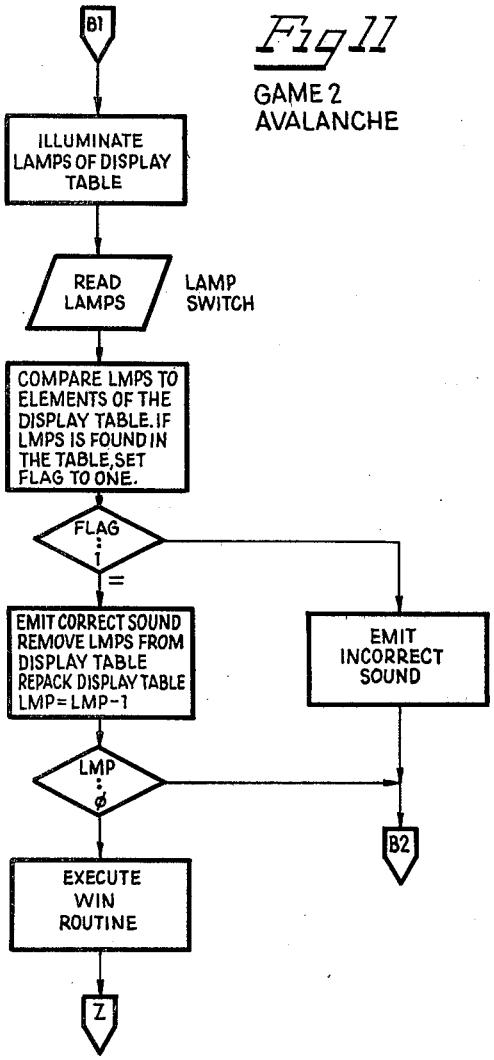
Figure 12:
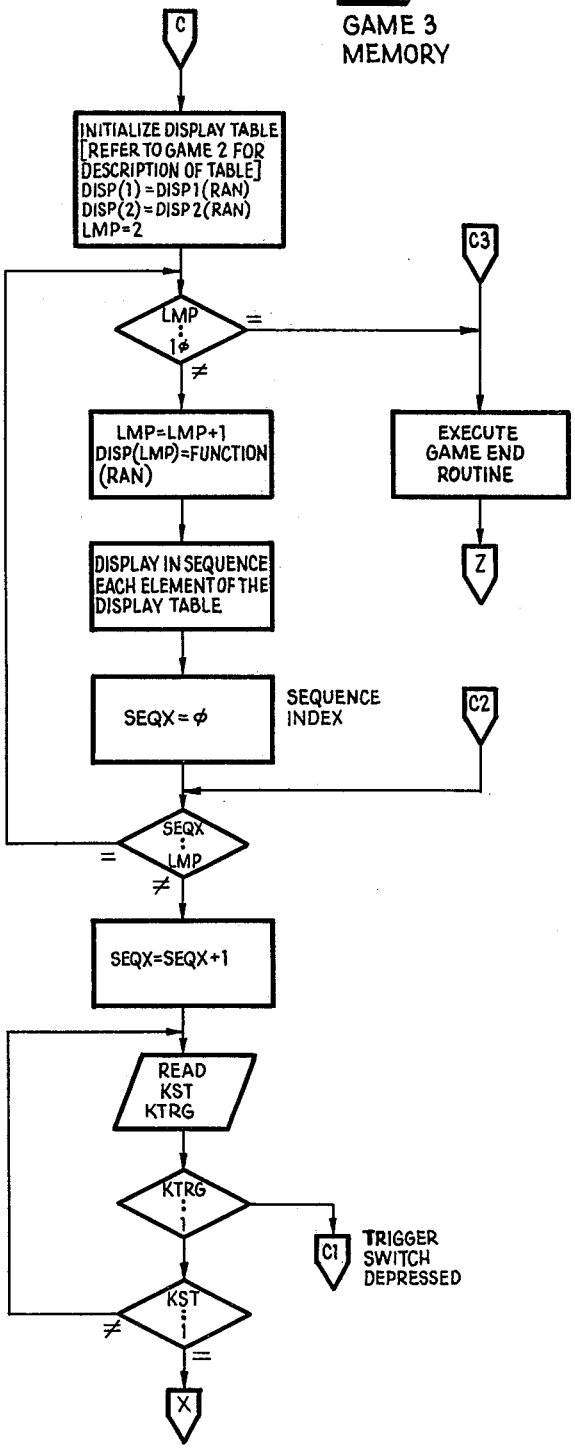

Referring now to FIG. 5, the transparent cover 16 is shown in the upper, raised position to permit movement of the movable object 18 such as the rolling of a ball 18 over the playing surface 14. The lowered position of the transparent cover 16 is shown in phantom at 60 in contact with the top surface of the movable object 18 to actuate playing field array positions.

In FIG. 5, the movable object 18 is shown disposed over one of the playing array positions 20. Each of the playing array positions 20 includes a movable actuator portion 62 fabricated from a transparent or translucent material. At opposite ends of the actuator 62, locating tabs 64 are provided and aligned with apertures in the component mounting board 42 to allow pivoting movement of the actuator 62. A portion of the actuator 62 is disposed to contact a pushbutton switch 66 provided for each of the array positions 20 to actuate the switch 66 when the movable object 18 is clamped by the cover 16 to depress the actuator 62 of the playing array position 20.

The pushbutton switch 66 includes an actuator 68 that is biased to a non-actuated position to raise the actuator 62 when the movable object 18 is not in contact with the actuator 62. An illumination source 70 such as an LED or the like is provided for each of the playing array positions and positioned directly below the actuator 62 of each of the playing area positions 20 to illuminate the playing array position. Each of the illumination sources 70 is selectively actuated by the control circuitry of the game device 10 as explained in more detail hereinafter in accordance with the play of the game. In an alternate arrangement, a portion of the actuator 62 includes a metallic section and a switch contact is provided in the position of the switch 66 to provide switch contacts in lieu of the switch 66.

In an alternate arrangement to that of the game device as illustrated in FIGS. 1 through 5, the handles 22, 24 and the actuators 26 are eliminated and movement of the transparent cover 16 is controlled by a game participant by directly actuating either a housing portion at 72 or a separate trigger actuator control to provide control of the raising and lowering of the transparent cover 16.

Various types of games are playable on the game device 10 as illustrated in FIGS. 1 through 5 with a particular type of game being selected by appropriate operation of the game selector switch 32. Four types of games are described hereinafter as illustrative of the games that can be played on the game device 10 although the control circuitry of the game device 10 may be programmed to provide various other games or schemes of play. Thus, the four types of games described hereinafter should be interpreted as illustrative only and not in any limiting sense.

GAME 1 - FAST AND ACCURATE

With the on-off switch 78 positioned to the on position, the type of game programmed as Game 1 of the device 10 will be activated when the start game, pushbutton switch 34 is operated. In the Fast and Accurate game, the play of the game proceeds in a first round with all the playing field array positions being dimly lighted on a continuous basis and the electronic control circuitry proceeds to alternately, brightly illuminate one of the playing field array positions to flash the respective illumination source 70 for a predetermined period of time, five seconds for example in skill lever 3. During the period of time that the illumination source 70 is energized in a flashing manner, the game player has an opportunity to achieve a predetermined point score, 25 points for example, by maneuvering the movable object 18 over the flashing playing field array position 20 and clamping the cover 16 whereupon the control circuitry extinguishes the flashing of the illumination source 70. If the game player is not successful in actuating the flashing array position before the time limit, the game player loses the opportunity to score points and the array position is extinguished. Further, five points are deducted from the game player's score. Additionally as a penalty feature, if the game player actuates an array position other than the flashing array position by clamping the cover 16, five points are deducted from his score. The electronic control circuitry in accordance with a random selection proceeds to the second round and actuates another playing field array position in a flashing manner and the player must then attempt to maneuver the playing object 18 to the flashing array position and clamp the cover 16 to terminate the flashing of that array position. The object of the game is to obtain a maximum cumulative score for the various rounds within a fixed overall game time limit, 60 seconds for example.

During a play of the game, the control circuitry generates a game background sound, such as a warbling space effect sequence. Further, a positive success sound such as a single high frequency tone is generated whenever a player successfully actuates a flashing playing array position. A failure sound such as a low frequency sound or simulated raspberry is generated if the player actuates a non-flashing array position or fails to extinguish the playing field array position within the prescribed time limit. After the game time limit expires an end of game sound is generated such as an interrupted low frequency tone.

The overall scoring of the game player for the various number of rounds is output at the end of the game. The scoring sequence starts with five interrupted high frequency tones for example with a synchronized flashing of all the field positions. The cumulative game player score is then displayed by flashing of the field array positions bearing the appropriate numerical indicia.

In the preferred embodiment of Game 1, the time for each round is varied in accordance with the skill level and with successive rounds in the overall game time. For example, in skill level 1, the first three rounds have a 15 second time limit, the fourth through sixth rounds have a 12 second time limit and the seventh through last rounds have a 6 second time limit. Similarly, the skill three level allows five seconds for rounds 1–3, four seconds for rounds 4–6, three seconds for rounds 7–9, and two seconds for additional rounds. The time level for the various rounds for skill level 2 is 10, 8, 6, and 4 seconds.

GAME 2-AVALANCHE

With the game selector 32 in the Game 2 position, the play of the game proceeds with all playing array positions dimly illuminated. When the start button 34 is actuated, three field positions at random begin to flash brighter than the other array positions. Further, the control circuitry is programmed to actuate an additional field array position to flash for each successive time period of game play duration; each three seconds for example in skill level 3. The object of the Avalanche game is for the player to extinguish all flashing array positions. Thus the player begins to play the game by attempting to maneuver the movable object 18 over one of the flashing array positions and actuate that position by clamping the cover 16. If the player is successful and extinguishes one of the field array positions within the first time period of game play, only two array positions remain flashing. However, after the expiration of the first time period another array position will begin to flash. The player then attempts to extinguish as many flashing array positions as possible and the play of the game continues until either all array positions are extinguished or the control circuitry actuates five array positions in the flashing manner.

In this game there is no particular score that is accumulated but the control circuitry in one embodiment accumulates the time in seconds that it takes a player to successfully extinguish all flashing array positions. The time in seconds at the end of the game can be indicated to the game player by the sequential flashing of the numbered array positions. Alternatively, the number of seconds to successfully complete the game is normalized to a value between 0 and 1000 and the displayed score is read out by actuation of the array positions. If the player does not succeed in extinguishing all array positions before the game time limit, the end of game signal is generated. Further, if the game device proceeds to actuate five flashing array positions, the game device wins and an appropriate signal is generated. If the player extinguishes all the array positions before the game time limit, the win signal is generated.

The game device provides a penalty feature for "misses" dependent on the skill level; a miss being the actuation of a non-flashing array position. For example, in skill level 3, the game device actuates an additional array position for each miss. In skill level one, two misses are allowed before an additional penalty array position is actuated and in skill level 2, one miss is allowed.

GAME 3-MEMORY

In the memory game, with the game selector switch in the three position, and the start pushbutton 34 actuated, the control circuitry momentarily actuates four playing field array positions in a sequence. For example, the playing field array positions one, seven, three, and six are momentarily and sequentially actuated. The game player attempts to memorize the randomly generated sequence in which the array positions were illuminated and then attempts to actuate the playing field array positions in the order in which they were actuated.

If the game player actuates each of the playing field array positions in the proper sequence, the respective array position that is correctly contacted by the movable object in sequence is actuated. At the end of a successful actuation of the sequence, the control circuitry then momentarily actuates another sequence of field array positions in a second round and the player again attempts to actuate the array positions in that same sequence. The object of the Memory game is to successfully complete as many consecutive rounds or sequences as possible. The control circuitry maintains a scoring in terms of how many rounds the game player has successfully completed during a predetermined time interval of game play.

In a preferred embodiment, each successive round provides a sequence with one additional array position.

Further, the number of seconds per round are varied according to the skill level. For example, 45 seconds are allowed as a time limit to successfully activate the sequence in skill level 1, 30 seconds in skill level 2 and 15 seconds in skill level 3.

Additionally, the number of misses allowed in sucessfully completing each round is also varied with the skill level. For example, in skill level 3, no misses are allowed and the first incorrect actuation of an array position ends the round. In skill level 1, two misses are allowed and in skill level 2, one miss is allowed.

The scoring of the memory game provides 100 points for each successfully completed round for a total maximum score of 1,000.

As an alternative embodiment to the actuation of each array position by the clamping of the cover 16 against the movable object 18, the movable object 18 and the switch actuator 62 are suitable designed to provide for actuation of an array position by the force resulting from the mass of the movable object 18 on the actuator 62. The entry of an actuation for an array position is controlled either solely by the presence of the movable object on an array position actuator 62 or by a suitable trigger switch on the housing 12 manually operable by the game player. Further, the movable cover 16 is utilized to control movement of the movable object 18 to thus prevent undesired movement by clamping. Alternatively, the cover 16 is not utilizable during the play of the game and serves only for inhibiting the movement of the movable object 18 at the start of each round to render the orientation of the plane of the playing area 14 less critical. The operation of the cover 16 during the play of a round would then reset the game device to the next round and end the current round.

A shut-off signal is generated by the game device every 25 seconds, for example, to warn the game player that power is on.

Figure 6:
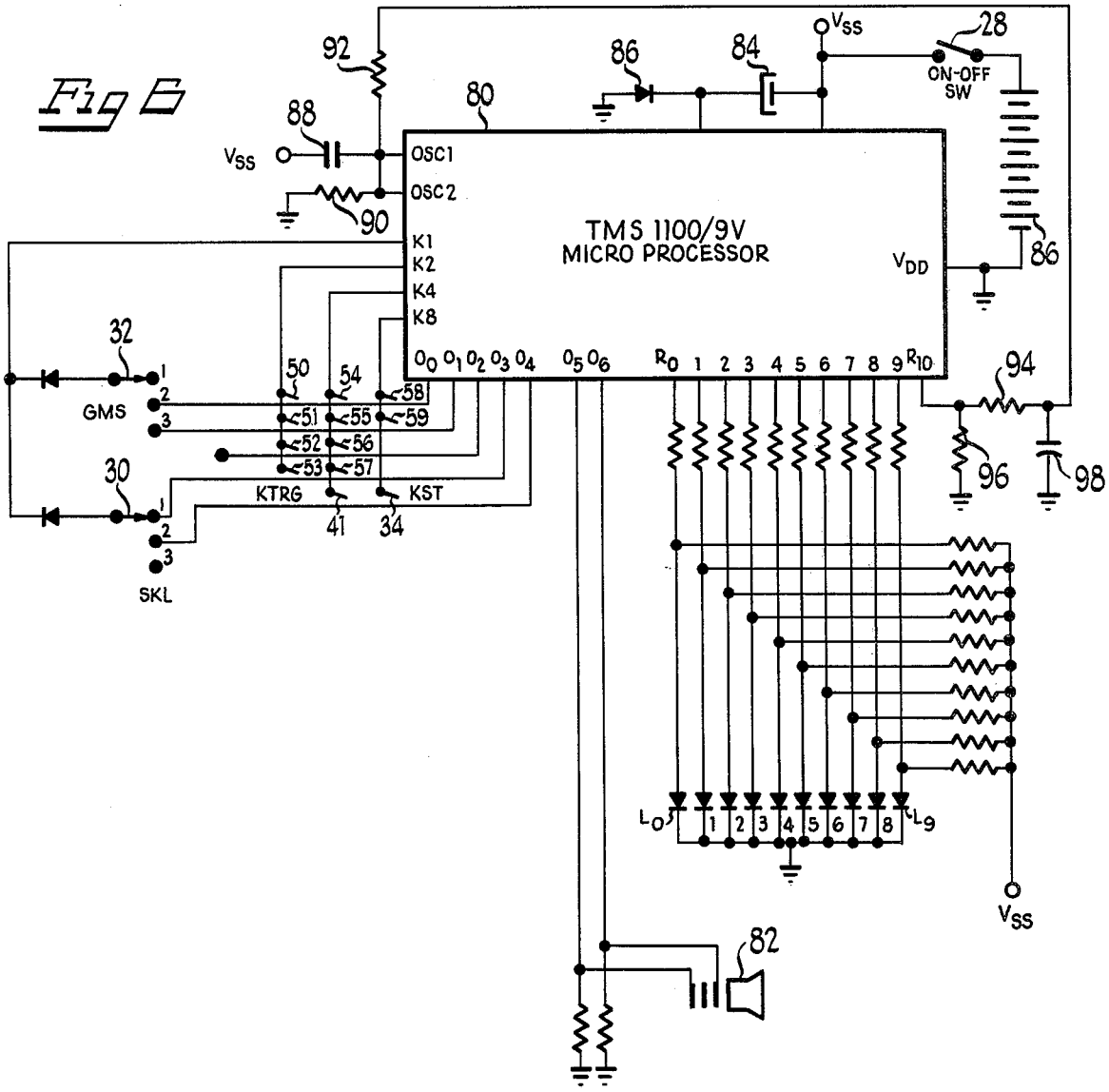
FIG. 6 is a detailed schematic diagram of the electronic circuitry of the game device of FIGS. 1 through 5 according to the present invention.

Referring now to FIG. 6, the game device 10 utilizes a microprocessor 80 having an input-output section that connects the array position switches 66 to a computing device including an arithmetic logic unit, a read only memory and a random access memory. The arithmetic logic unit processes the inputs received from the various input devices in accordance with the game type selected from the read only memory by the game selector switch 32. The arithmetic logic unit through the input-output section also controls operation of the array position illumination sources 70 and a speaker 82 to generate the various game signals in accordance with the rules of the games selected.

Thus, when one of the games stored in the read only memory is selected by the selector switch 32, the arithmetic logic unit operates on the sample inputs from the array of position switches 66 to perform the necessary arithmetic logic steps and to store the necessary data such as the operation of a correct array position switch 66 in a random access memory.

The microprocessor 80 is readily implemented by a single chip, large scale integrated circuit microprocessor as the main computing device. A TMS 1100 single chip microprocessor manufactured by Texas Instruments Inc. and described in the TMS 1000 Series Data Manual published December 1975 is suitable for use as the microprocessor 80.

A time delay circuit including a capacitor 84 and a diode 86 are utilized to reset and initialize the operation of the microprocessor 80 each time the on-off switch 28 is actuated to connect the power source 86, a 9-volt battery supply for example. A timing circuit comprising a capacitor 88 and a resistor 90 are connected to the oscillator inputs of the microprocessor 80 to control the operation of the internal clock of the microprocessor 80. Additionally, resistors 92, 94 and 96 and a capacitor 98 are connected in a network between the R 10 output and the oscillator inputs of the microprocessor 80 to further control the internal clock of the microprocessor 80 for the provision of warble sound signal generation.

The microprocessor 80 is programmed in a manner described in the TMS 1100 Data Manual published by Texas Instruments to perform the functions necessary to play the game types as described hereinbefore. In this regard, logical flow charts describing the logical flow of the required programmed steps for programming the games described hereinabove including games one through three are shown in FIGS. 7 through 13.

Figure 2:
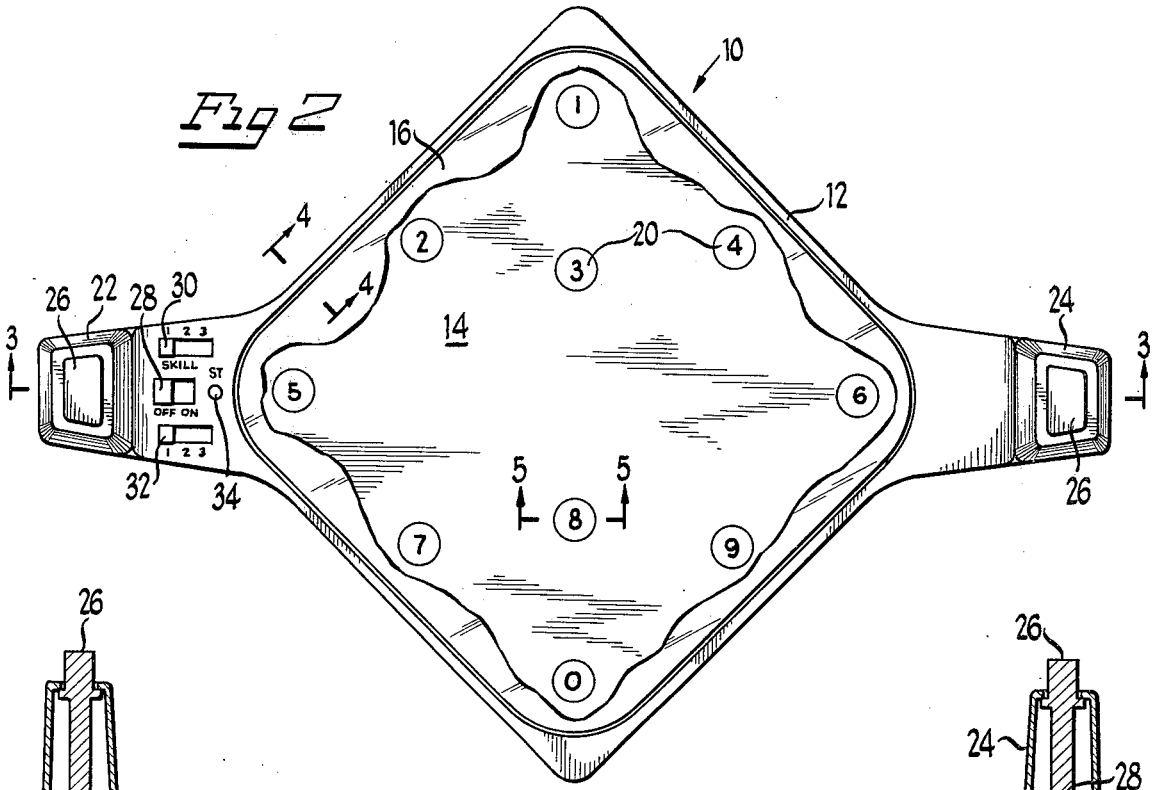
FIG. 2 is a plan view of the game device of FIG. 1 with portions cut away.

In operation and during the play of the game, the microprocessor 80 monitors and the state of the array position switches 66 identified as S0 through S9 and corresponding to the ten array positions as indicated in FIGS. 1 and 2. Further, the microprocessor 80 also monitors the state of the game selector switch 32, the start switch 34, and the skill switch 30 by sequentially energizing its outputs $O_0$ through $O_4$ while monitoring the inputs K1, K2, K4 and K8. The O5 and O6 outputs are utilized by the microprocessor 80 to drive the speaker 82 to generate the appropriate tones and tone sequences for use during the play of the game as described hereinbefore.

The R0 through R9 outputs of the microprocessor 80 are each connected through a resistor to control a respective one of the illumination sources 70 for each array position, the illumination sources 70 in FIG. 6 being designated as L0 through L9 corresponding to the ten field array positions. Thus, when the R0 output is energized, the illumination source 70 corresponding to the O field array position is actuated.

Concerning the monitoring of the various switch conditions, when the $O_0$ output is energized, for example, the microprocessor 80 determines the state of the S8, S4 and S0 array position switches 70 and the Game 2 position of the selector switch 32 by monitoring the respective K8, K4, K2 and K1 inputs.

The game selector switch 32 illustrated in FIG. 6 is a single pole three position switch arrangement. The VSS supply connection is connected to each of the illumination sources L0 through L9 through a suitable resistor for each respective illumination source. Thus, the illumination sources L0 through L9 are actuated in a dimly lit mode for background illumination purposes when the on-off switch 32 is actuated. The trigger switch 41 denoted as KTRG is arranged to be sensed by the K4 sense input when the $0_4$ output is energized. Similarly, the start switch 34 denoted KST is arranged to be sensed by the K8 sense input when the $O_4$ output is engergized.

Obviously, many modifications and variations of the present invention are possible in light of the above teachings. Thus, it is to be understood that within the scope of the appended claims, the invention may be practiced otherwise as specifically described above.

For example, the sensing of the contact of the movable object 18 on the array position 20 in alternate embodiments is accomplished by sensing arrangements other than the actuator 62 and the switch 66. For example, a contact sheet with switch contacts formed at the array positions 20 may be utilized or capacitive or magnetic sensing of the movable element 18 is also possible.

What is claimed and desired to be secured by Letters Patent of the United States is:

1. Game apparatus comprising:

a housing defining a playing surface and including means for selectively altering the orientation of said playing surface;

a movable object disposed and being movable on said playing surface in response to the orientation of said playing surface;

a plurality of playing field array positions defined on said playing surface, each of said playing field array positions comprising means responsive to said movable object for sensing the presence or absence of said movable object and providing an output indicative thereof, each of said playing field array positions further comprising illumination source means for illuminating a respective one of said playing field array positions;

electronic control means responsive to said outputs of said sensing means and controlling the illumination state of said illumination source means, said electronic control means comprising means for selectively actuating on a random basis one or more of said illumination source means and deactuating each of said actuated illumination source means in response to said respective sensing means outputting an indication of the presence of said movable object; and player actuable means for contacting said movable object and applying an actuating force directly downward through said movable object to said field array positions to actuate said sensing means when said movable object is directly over one of said array positions and said player actuable contacting means is operated, said player actuable contacting means comprising a movable, transparent cover disposed generally parallel to the plane of said playing surface and a manually actuable player actuator control for moving said cover between a raised position and a lowered movable object contacting position.

2. The game apparatus of claim 1 further comprising entry control means responsive to operation of said player actuable means for providing an entry control signal to said electronic control means.

3. The game apparatus of claim 1 wherein said electronic control means further comprises scoring accumulation means responsive to said sensing means and said selective actuating means for accumulating a score representing the agreement between the outputs of said sensing means and the actuated illumination sources.

4. The game apparatus of claim 3 wherein said scoring accumulation means further comprises means for adding a predetermined number of points for each agreement between the output of said sensing means and the actuated illumination source and for subtracting a predetermined number of points for each disagreement between the output of said sensing means and the actuated illumination source.

5. The game apparatus of claim 1 wherein said electronic control means further comprises round control means responsive to said sensing means for successively controlling said selective actuation means in response to said output of said sensing means corresponding to said actuated illumination source.

6. The game apparatus of claim 5 wherein said round control means further comprises round time determination means for initializing and terminating a predetermined round time interval and controlling operation of said round control means.

7. The game apparatus of claim 6 further comprising skill level setting means, said round time determination means comprising round time varying means responsive to said skill level setting means for varying said predetermined round time interval.

8. The game apparatus of claim 6 wherein said round time determination means further comprises means for decreasing said predetermined round time for successive rounds in a predetermined manner.

9. The game apparatus of claim 1 wherein said selective actuating means comprises means for operating said one or more illumination sources in a periodic manner such that said actuated illumination source flashes.

10. The game apparatus of claim 1 wherein said selective actuating means further comprises means for continuously actuating said illumination sources in a first predetermined illumination mode and means for actuating said one or more selectively actuated illumination sources in a second predetermined illumination mode.

11. The game apparatus of claim 10 wherein said first predetermined illumination mode includes means for providing dim background illumination and said second predetermined illumination mode includes means for providing a brightly flashing illumination.

12. The game apparatus of claim 1 wherein said orientation altering means comprises a generally curved bottom housing portion for orientating said playing surface and said game apparatus with respect to a horizontal plane.

13. The game apparatus of claim 6 wherein said selective actuating means comprises means for actuating one or more of said illumination sources on a random basis at the start of a timed round and time control means for actuating an additional one of said illumination sources on a random basis for each predetermined interval of time occurring after the start of said timed round.

14. The game apparatus of claim 1 wherein said movable playing object is a ball that is maneuvered over said playing surface as a game player manipulates the orientation of said playing surface.

15. The game apparatus of claim 1 wherein said player actuable means further comprises at least two upstanding handles extending from said housing, said manually actuable player actuator control comprising an actuator carried by each of said upstanding handles.

16. An electronic game device comprising:

a housing defining a playing area;

a movable playing object disposed on said playing area and being movable thereon;

playing area position sensing means for defining a first predetermined plurality of playing area positions and for sensing the presence of an applied force greater than a predetermined magnitude to each of said predetermined pluralty of playing area positions;

player actuable means for contacting said movable playing object and applying an actuating force directly through said movable playing object to each of said playing area positions when said movable playing object is directly over a respective playing area position;

playing area position illumination means for selectively illuminating each of said first predetermined plurality of playing area positions on an individual playing area position basis; and electronic control means for selectively controlling the momentary actuation of said playing area position illumination means on an individual illumination means basis and being responsive to said playing area position sensing means, said electronic control means further comprising initializing means for sequentially and momentarily actuating a second predetermined number of said plurality of playing area positions on a random selection basis and means operative subsequent to said initializing means and responsive to said playing area position sensing means for detecting the playing object being moved over said second predetermined number of playing area positions in the same sequential order as said playing area positions were actuated by said initializing means.

* * * * *